US010024637B1

(12) United States Patent
Li

(10) Patent No.: US 10,024,637 B1
(45) Date of Patent: Jul. 17, 2018

(54) TARGET RESET SYSTEM

(71) Applicant: Gang Li, Aurora (CA)

(72) Inventor: Gang Li, Aurora (CA)

( * ) Notice: Subject to any disclaimer, the term of this patent is extended or adjusted under 35 U.S.C. 154(b) by 0 days.

(21) Appl. No.: 15/808,464

(22) Filed: Nov. 9, 2017

(51) Int. Cl.
*F41J 1/10* (2006.01)
*F41J 7/02* (2006.01)
*F41J 7/06* (2006.01)

(52) U.S. Cl.
CPC .. *F41J 1/10* (2013.01); *F41J 7/02* (2013.01); *F41J 7/06* (2013.01)

(58) Field of Classification Search
CPC .. F41J 7/04; F41J 7/06; F41J 1/00; F41J 1/10
USPC ..... 273/390–392, 406, 407
See application file for complete search history.

(56) References Cited

U.S. PATENT DOCUMENTS 4,699,116 A 10/1987 Freeland et al.
4,743,032 A * 5/1988 Summers ..... F41J 7/00 273/372
5,324,043 A * 6/1994 Estrella ..... F41J 7/04 273/391
6,257,583 B1 * 7/2001 Roberson ..... F41J 7/04 273/378
6,736,400 B1 5/2004 Cesternino
6,991,233 B2 1/2006 Goldsmith, Jr.
7,422,216 B1 9/2008 Underhill
7,681,886 B2 3/2010 Morrow et al.
8,608,169 B2 12/2013 Saunders et al.
2002/0030323 A1 * 3/2002 Slifko ..... F41J 7/04 273/391
2004/0195775 A1 * 10/2004 Goldsmith, Jr. ..... F41J 7/04 273/392
2004/0201172 A1 * 10/2004 Goldsmith ..... F41J 7/04 273/391
2005/0098954 A1 5/2005 Stutz
2016/0195369 A1 7/2016 Perry et al.

FOREIGN PATENT DOCUMENTS

DE 3931757 C2 4/1991
GB 2197058 A 5/1988

* cited by examiner

*Primary Examiner* — Mark Graham
(74) *Attorney, Agent, or Firm* — Millman IP Inc.

(57) ABSTRACT

In one aspect, there is provided a target reset system, which includes a frame, a plurality of target control arrangements and an actuator. The frame includes a pivot shaft. Each target control arrangement includes a target support member and a target support member spring. The target support member is configured to hold a target, and is pivotable on the pivot shaft between a stowage position and a use position. The target support member spring has a first spring end connected to the target support member and having a second spring end, wherein the first spring end is lockable to the frame to hold the target support member in the stowage position. The second spring end is lockable relative to the frame.

11 Claims, 18 Drawing Sheets

TARGET RESET SYSTEM

FIELD

This disclosure relates generally to target reset systems.

BACKGROUND

Systems are known that provide multiple targets for a user to shoot at during target practice with a projectile launching device such as a pistol, a rifle or a cross-bow. While known systems are useful in that they permit the user to hide and show targets for shooting at, some systems suffer from one or more problems. For example, some systems are expensive. Some systems leave portions exposed to impact from stray projectiles. Some systems are not as compact as would otherwise be desired. Some systems are difficult to scale so as to constructed to hold fewer or more targets. Some systems are not portable. It would be desirable to provide a target reset system that addresses one or more of these problems.

SUMMARY OF THE DISCLOSURE

In one aspect, there is provided a target reset system, which includes a frame, a plurality of target control arrangements and an actuator. The frame includes a pivot shaft. Each target control arrangement includes a target support member and a target support member spring. The target support member is configured to hold a target, and is pivotable on the pivot shaft between a stowage position and a use position. The target support member spring has a first spring end connected to the target support member and having a second spring end, wherein the first spring end is lockable to the frame to hold the target support member in the stowage position. The second spring end is lockable relative to the frame. When the first spring end is unlocked from the frame while the second spring end is locked to the frame, the target support member spring pivots the target support member from the stowage position to the use position. When the second spring end is unlocked from the frame while the target support member is in the use position, the target support member moves to the stowage position. The actuator is movable to unlock the second spring end of a first one of the plurality of target control arrangements from the frame while the target support member of the first one of the plurality of target control arrangements is in the use position, and to unlock the first spring end of a second one of the plurality of the target control arrangements from the frame while the second spring end of the second one of the plurality of the target control arrangements is locked to the frame, so as to cause the target support member from the first one of the plurality of target control arrangements to move to the stowage position and to cause the target support member from the second one of the plurality of target control arrangements to move to the use position.

BRIEF DESCRIPTIONS OF THE DRAWINGS

For a better understanding of the embodiment described herein and to show more clearly how they may be carried into effect, reference will now be made, by way of example only, to the accompanying drawings in which.

DETAILED DESCRIPTION

Figure 1:
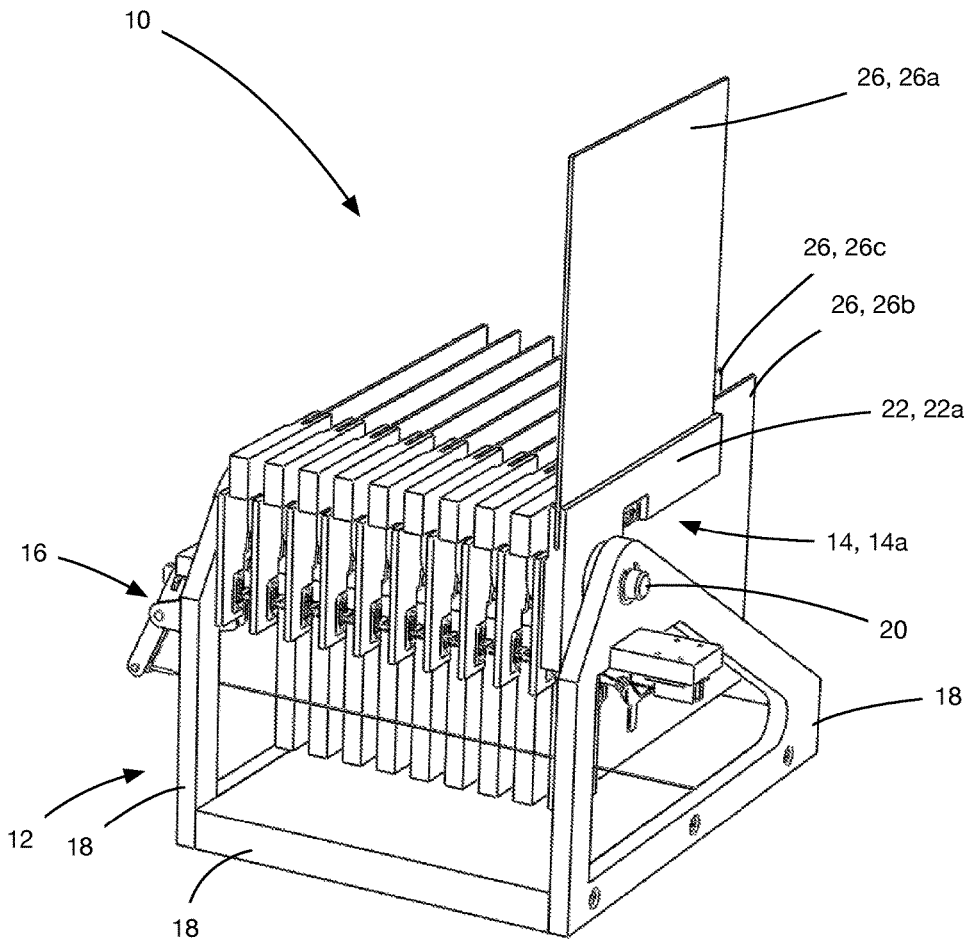
FIG. 1 is a perspective view of a target reset system in accordance with an embodiment of the present disclosure.
Figure 2:
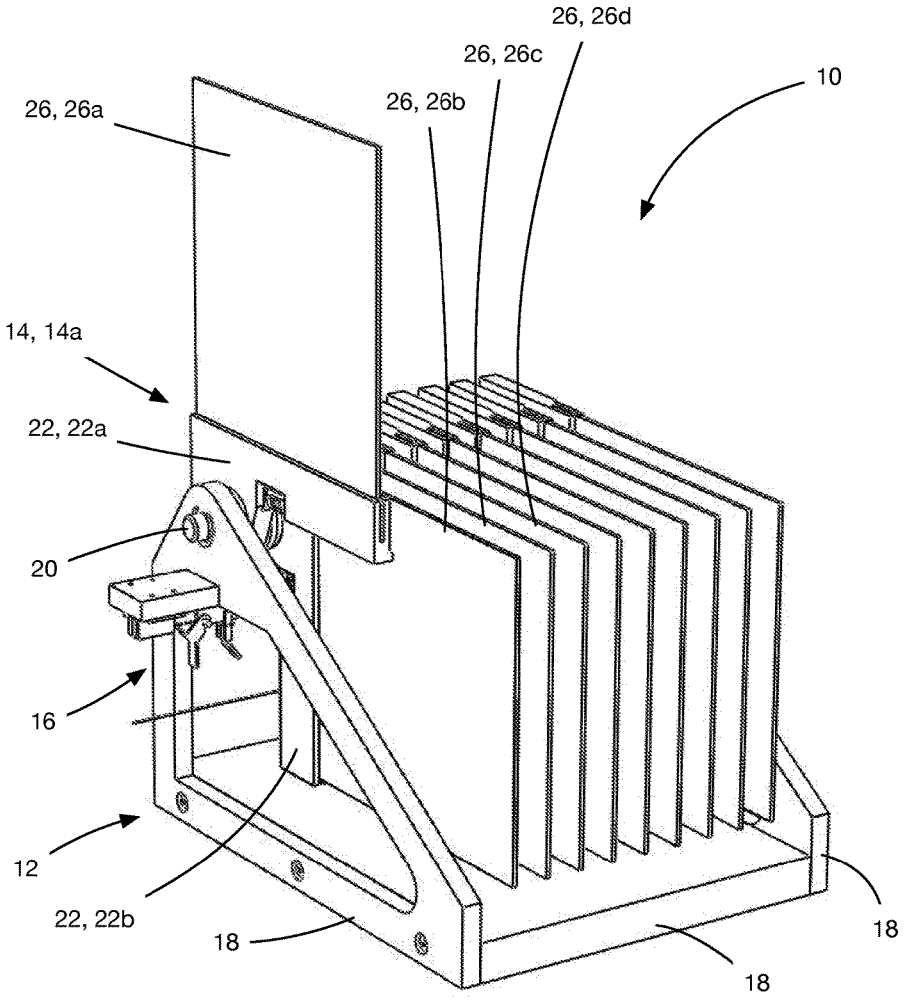
FIG. 2 is another perspective view of the target reset system shown in FIG. 1.
Figure 3:
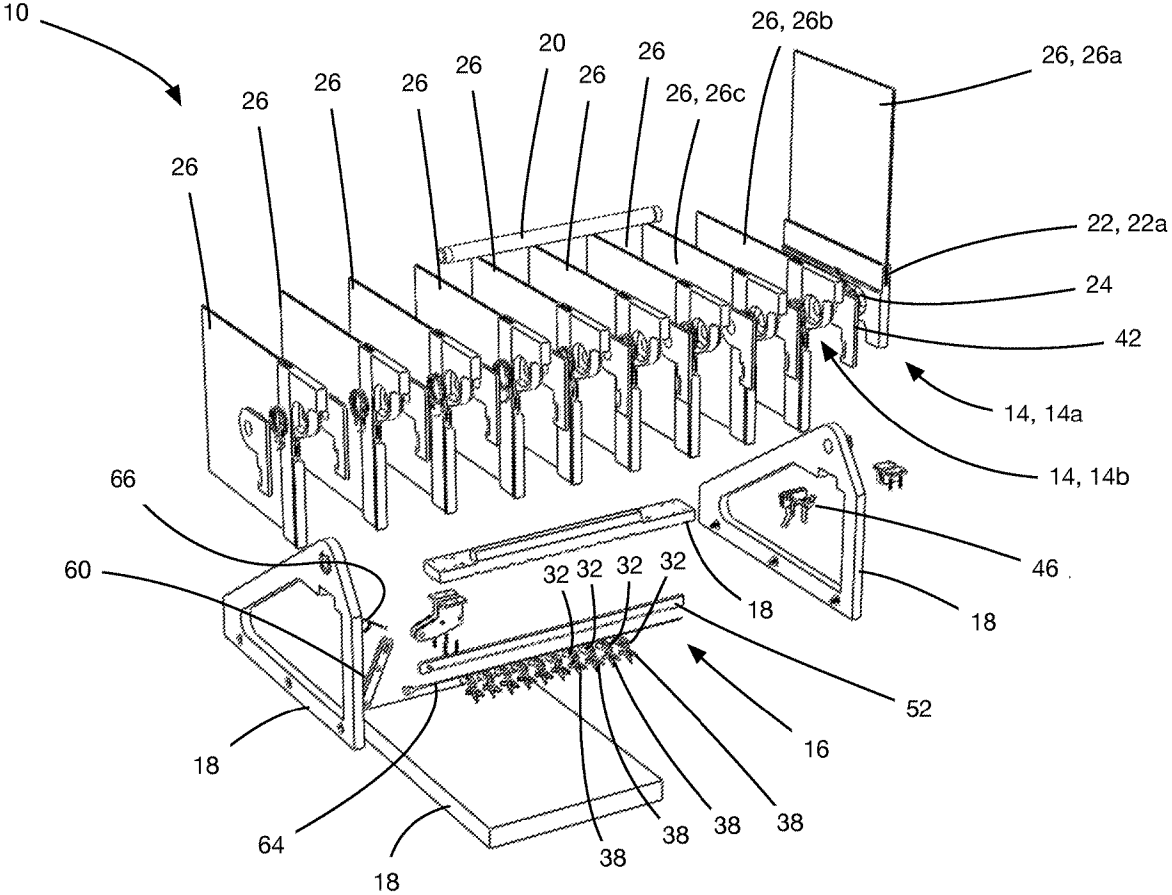
FIG. 3 is an exploded perspective view of the target reset system shown in FIG. 1.
Figure 4:
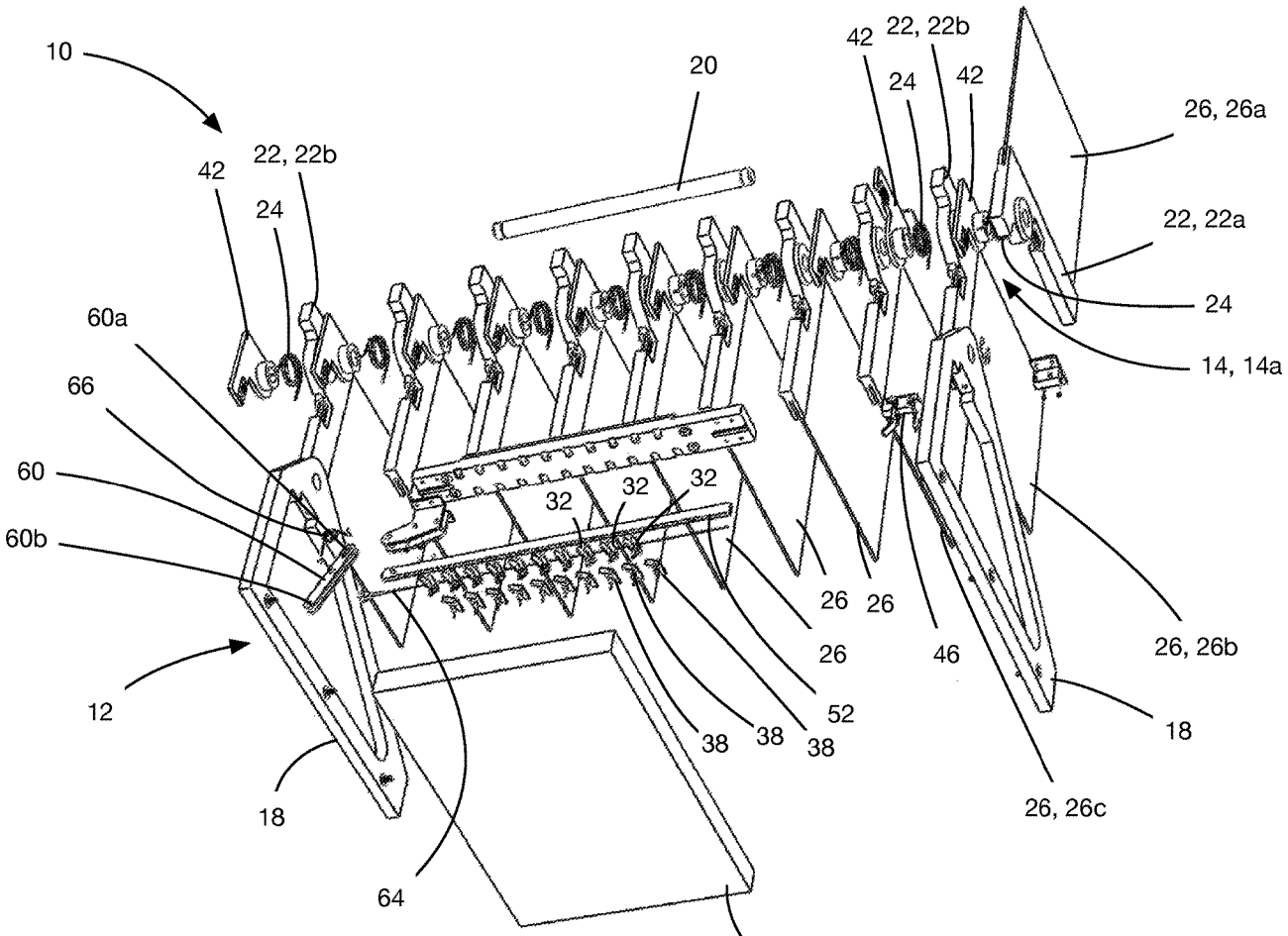
FIG. 4 is another exploded perspective view of the target reset system shown in FIG. 1.
Figure 5:
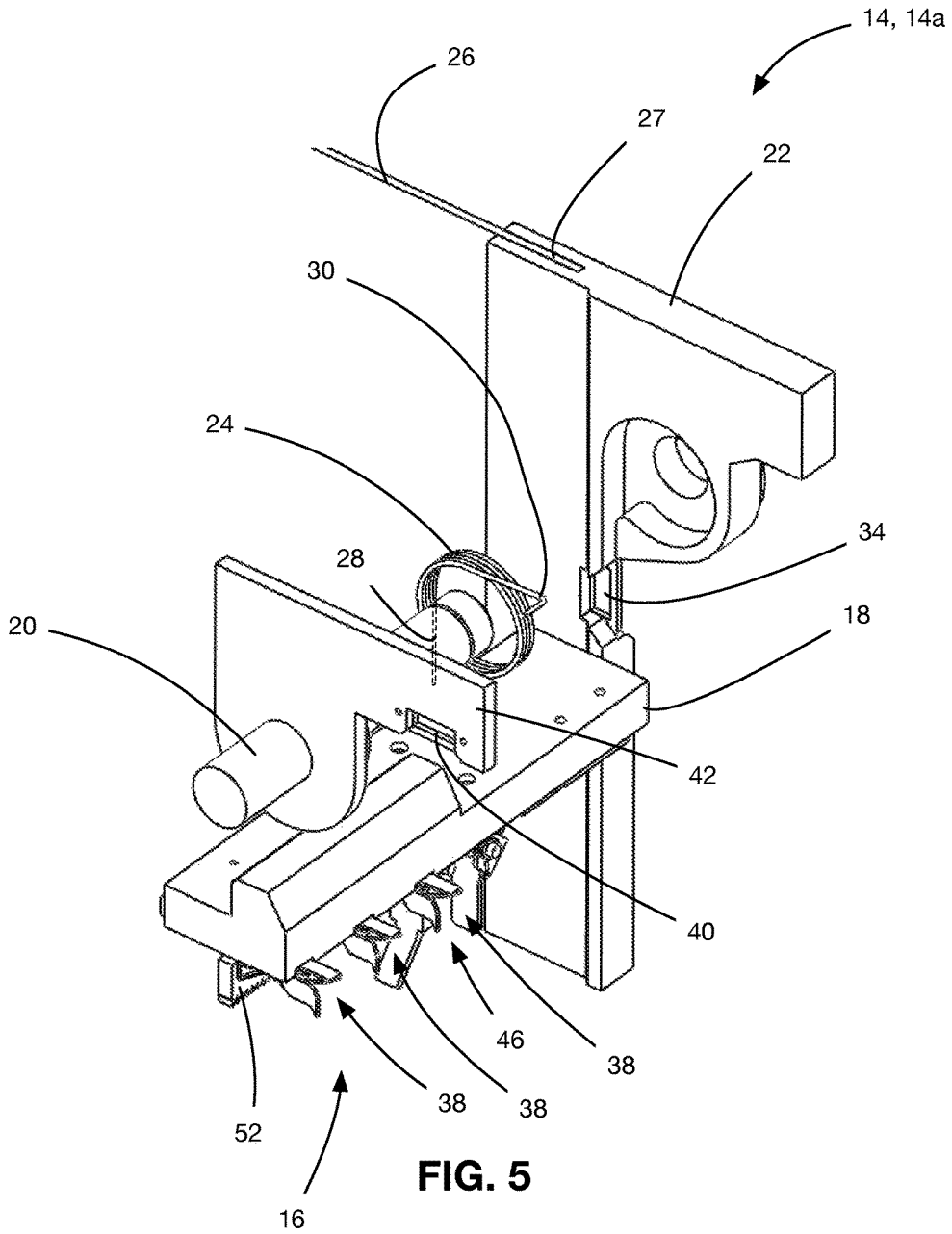
FIG. 5 is an exploded perspective view of a target support arrangement from the target reset system shown in FIG. 1.

Reference is made to FIGS. 1 and 2, which show a target system 10 that permits a user to sequentially bring a plurality of targets into a use position from a stowage position so that the user can fire projectiles such as bullets and arrows at the targets. The target reset system 10 includes a frame 12, a plurality of target control arrangements 14 and an actuator 16.

The frame 12 includes a plurality of structural elements 18 and a pivot shaft 20. As better seen in FIGS. 5-8, each target control arrangement 14 includes a target support member 22 and a target support member spring 24. The target support member 22 is configured to hold a target 26 in any suitable way. For example, the target support member 22 may include a slot 27 to frictionally hold the target 26, which may be made from plastic material. Additionally, mechanical fasteners such as screws may be inserted through the target 26 into the target support member 22 to ensure that the target 26 is more securely held. The target 26 itself may have any suitable indicia on it, such as concentric circles, or shapes representing a person's head and torso, or any other suitable indicia. The target support member 22 is pivotable on the pivot shaft 20 between a stowage position (FIGS. 6 and 8) and a use position (FIG. 7). In general, throughout this disclosure, when the target support member 22 is referred to as moving to or being in the stowage position of the use position, it is equivalent to the associated target 26 being moved to or being in the stowage position or the use position.

The target support member spring 24 (FIG. 5) may be any suitable type of spring, such as, for example, a torsion spring that is supported on the pivot member 20. The target support member spring 24 has a first spring end 28 connected to the target support member 22, and further has a second spring end 30.

Figure 6:
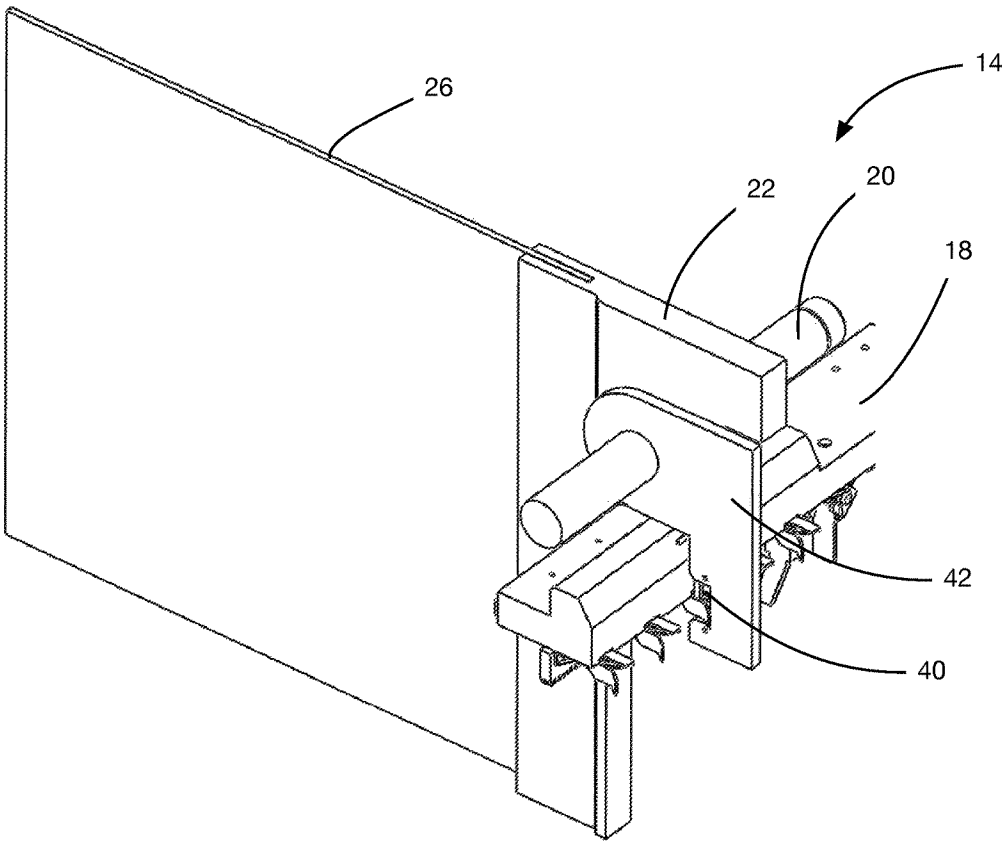
FIG. 6 is an unexploded perspective view of a target support arrangement shown in FIG. 5, in a reset position.
Figure 7:
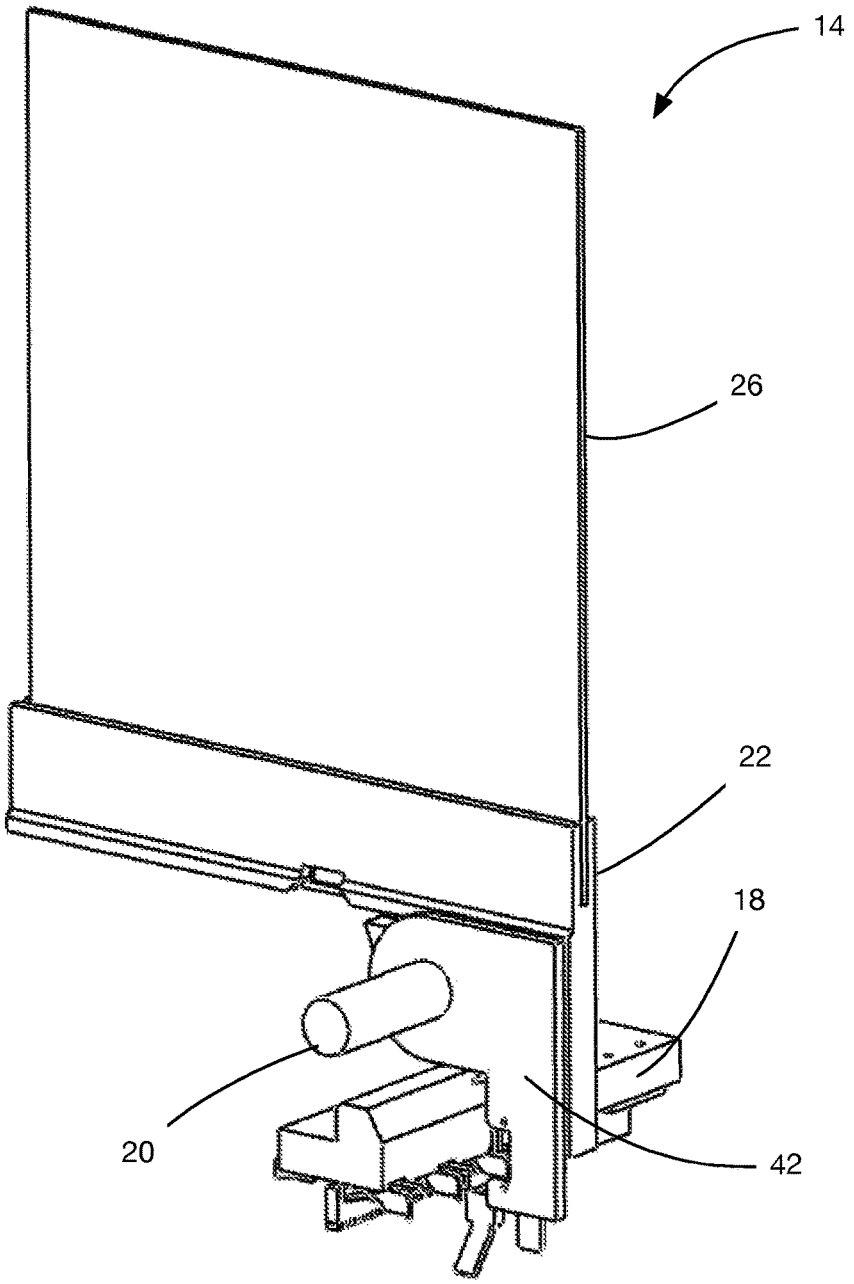
FIG. 7 is an unexploded perspective view of the target support arrangement shown in FIG. 5, in a raised position.
Figure 8:
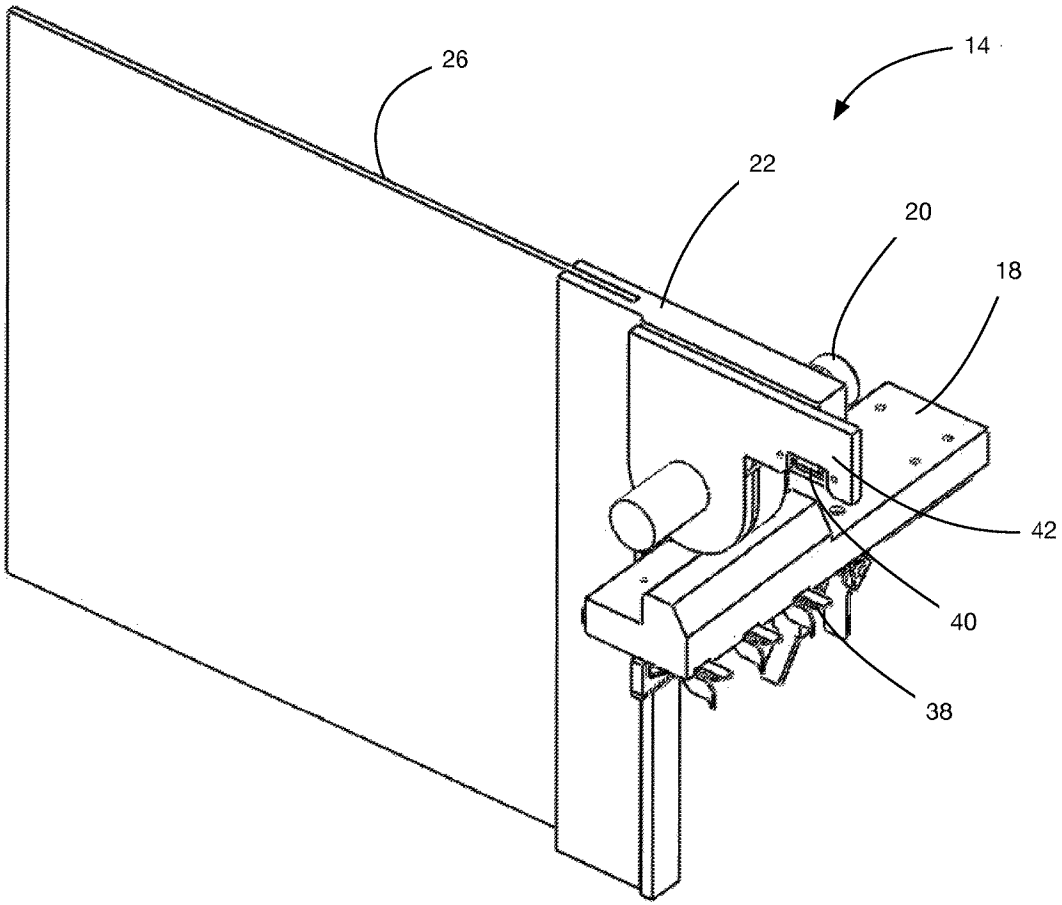
FIG. 8 is an unexploded perspective view of the target support arrangement shown in FIG. 5, in a stowage position.

The first spring end 28 is lockable to the frame 12 to hold the target support member 22 in the stowage position as shown in FIGS. 6 and 8. The locking may take place via a first latch arm 32 that releasably engages a first latch receiver 34. In the embodiment shown, the first latch arm 32 is pivotally mounted to the frame 12 as can be seen in FIGS. 10-15, while the first latch receiver 34 (FIG. 5) is an aperture that is provided on the target support member 22 and which is sized to receive the first latch arm 32. The first latch arm 32 may be movable between a locking position (FIGS. 10-12 and 14-15) and a release position (FIG. 13), and may be biased towards the locking position by way of a first latch arm spring 36 (FIGS. 10-15), which may be any suitable type of spring, such as a torsion spring.

The second spring end 30 is lockable to the frame 12 as shown in FIGS. 6 and 7. The locking may take place via a second latch arm 38 that releasably engages a second latch receiver 40. The second latch arm 38 is pivotally mounted to the frame 12 as can be seen in FIGS. 10-15, while the second latch receiver 40 (FIGS. 6-8) is an aperture that is provided on a second spring end extension member 42 that holds the second spring end 30 and that is pivotable about the pivot shaft 20. Thus, the second spring end extension member 42 is lockable to the frame 12 to lock the second spring end 30 to the frame 12. The second latch arm 38 may be movable between a locking position (FIGS. 10 and 12-15) to hold the second spring end extension member 42 (and therefore the second spring end 30) in the first position, and a release position (FIG. 11) to release the second spring end extension member 42 (and therefore the second spring end 30) from its first position. The second latch arm 38 may be biased towards the locking position by way of a second latch arm spring 44 (FIGS. 10-15), which may be any suitable type of spring, such as a torsion spring.

When the first spring end 28 is locked to the frame (FIG. 6), and the second spring end 30 is locked to the frame 12, the target support member spring 24 is flexed and stores potential energy. As can be seen, the target support member 22 is held in the stowage position. When the target support member 22 is in the stowage position and the second spring end 30 is locked to the frame 12, the target support arrangement 14 may be referred to as being in a reset position.

When the first spring end 28 is unlocked from the frame 12 while the second spring end 30 is locked to the frame 12, the target support member spring 24 pivots the target support member 22 from the stowage position shown in FIG. 6 to the use position shown in FIG. 7, due to the spring 24 returning towards its rest position. During this step, it will be noted that the spring 24 raises the target support member 22 (and the target 26 held by it) to the use position against the force of gravity. When the target support member 22 is in the use position, and the second spring end 30 is locked to the frame 12, the target support arrangement 14 may be referred to as being in a use position.

When the second spring end 30 is unlocked from the frame 12 while the target support member 22 is in the use position, the target support member 22 moves from the use position to the stowage position (shown in FIG. 8). In the example shown, it moves to the stowage position under the force of gravity since its center of gravity is offset from the axis of the pivot shaft 20. When the target support member 22 is in the stowage position and the second spring end 30 is unlocked from the frame 12, the target support arrangement 14 may be referred to as being in a stowage position.

Thus, as can be seen from the above description, each target support arrangement 14 is positionable in three positions, a reset position as shown in FIG. 6 in which both the target support member 22 is locked to the frame in its stowage position and the second spring end extension member 42 (and therefore the second spring end 30) is locked to the frame 12 in its first position, a use position (FIG. 7) in which the target support member 22 is in its use position for shooting at by the user, while the second spring end extension member 42 (and therefore the second spring end 30) is in its first position, locked to the frame 12, and a stowage position (FIG. 8) in which the target support member 22 is in its stowage position, locked to the frame, while the second spring end extension member 42 is in its second position, unlocked from the frame 12.

The actuator 16 (FIG. 5) is movable to unlock the second spring end 30 of a first one of the plurality of target control arrangements 14 (shown at 14*a*) from the frame 12 while the target support member 22 of the first one of the plurality of target control arrangements 14 is in the use position, and to unlock the first spring end 30 of a second one of the plurality of the target control arrangements 14 (shown at 14*b*) from the frame 12 while the second spring end 30 of the second one of the plurality of the target control arrangements 14*b* is locked to the frame 12, so as to cause the target support member 22 from the first one of the plurality of target control arrangements 14 to move to the stowage position and to cause the target support member 22 from the second one of the plurality of target control arrangements 14*b* to move to the use position.

In the example shown, the actuator 16 includes a shuttle 46, (FIGS. 10-15 and FIGS. 16 and 17) that is movable along a ratchet member (shown at 52) from a first shuttle position (FIG. 10) to a second shuttle position (FIG. 14) to disengage the second latch arm 38 from the second latch receiver 40 of the first one of the plurality of target control arrangements 14*a*, thereby unlocking the second spring end 30 from the frame 12 of the first one of the plurality of target control arrangements 14*a*, and to disengage the first latch arm 32 from the first latch receiver 34 of the second one of the plurality of target control arrangements 14*b* thereby unlocking the first spring end 28 of the second one of the plurality of target control arrangements 14*b* from the frame 12.

With continued reference to FIGS. 10-15 and FIGS. 11 and 13 in particular, the first and second latch arms 32 and 38 have actuation surfaces 48 and 50 respectively. When the shuttle 46 passes by one of the first or second latch arms 32 or 38 the shuttle 46 engages the actuation surface 48 or 50 as the case may be, and thereby moves the first or second latch arm 32 or 38 such that the latch arm 32 or 38 disengages from the associated first or second latch arm receiver 34 or 40, thereby unlocking the associated first or second spring end 28 or 30 from the frame 12.

Figure 9A:
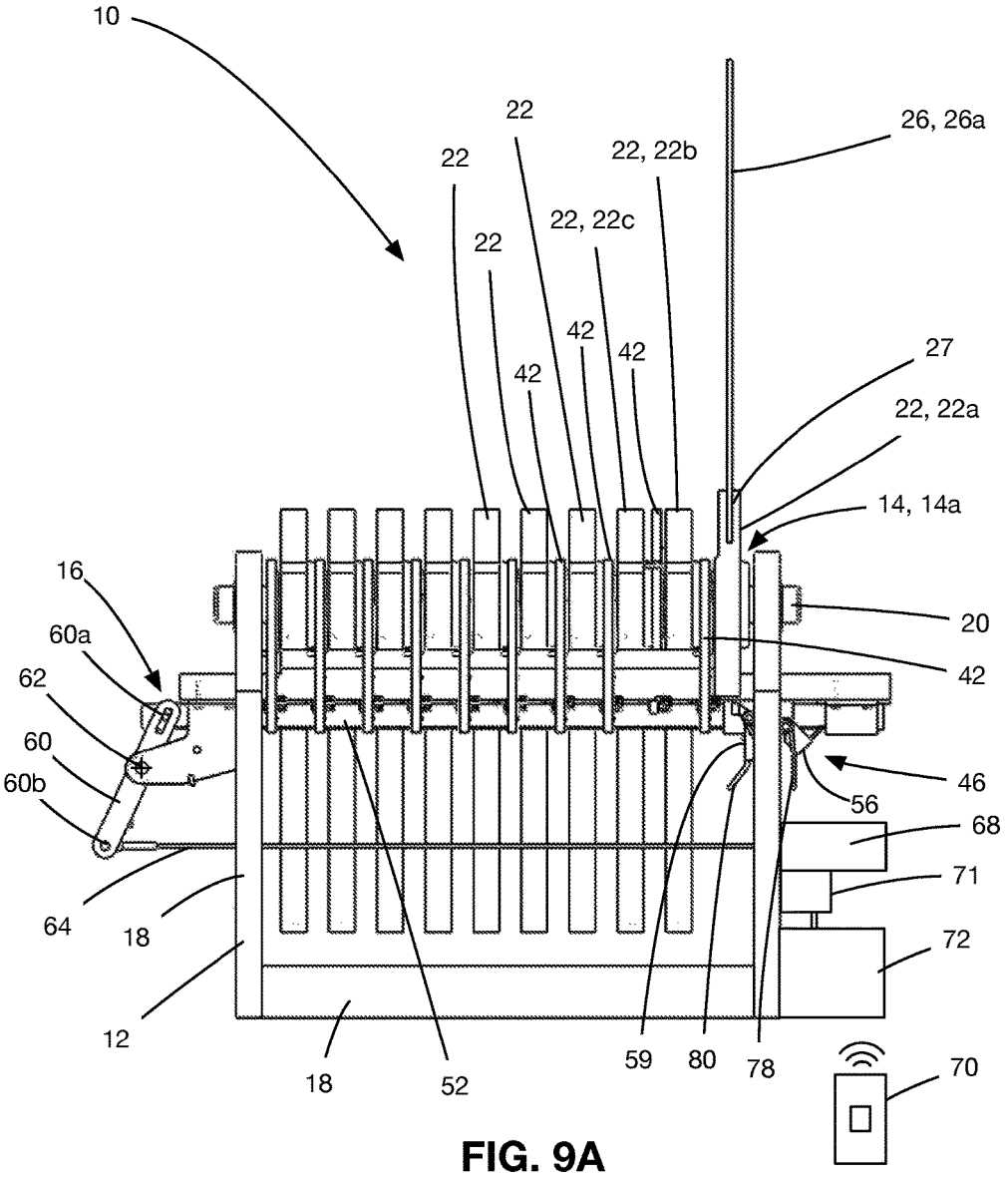
FIG. 9A is an elevation view of the target reset system shown in FIG. 1, with a ratchet member from an actuator in a first position.
Figure 9B:
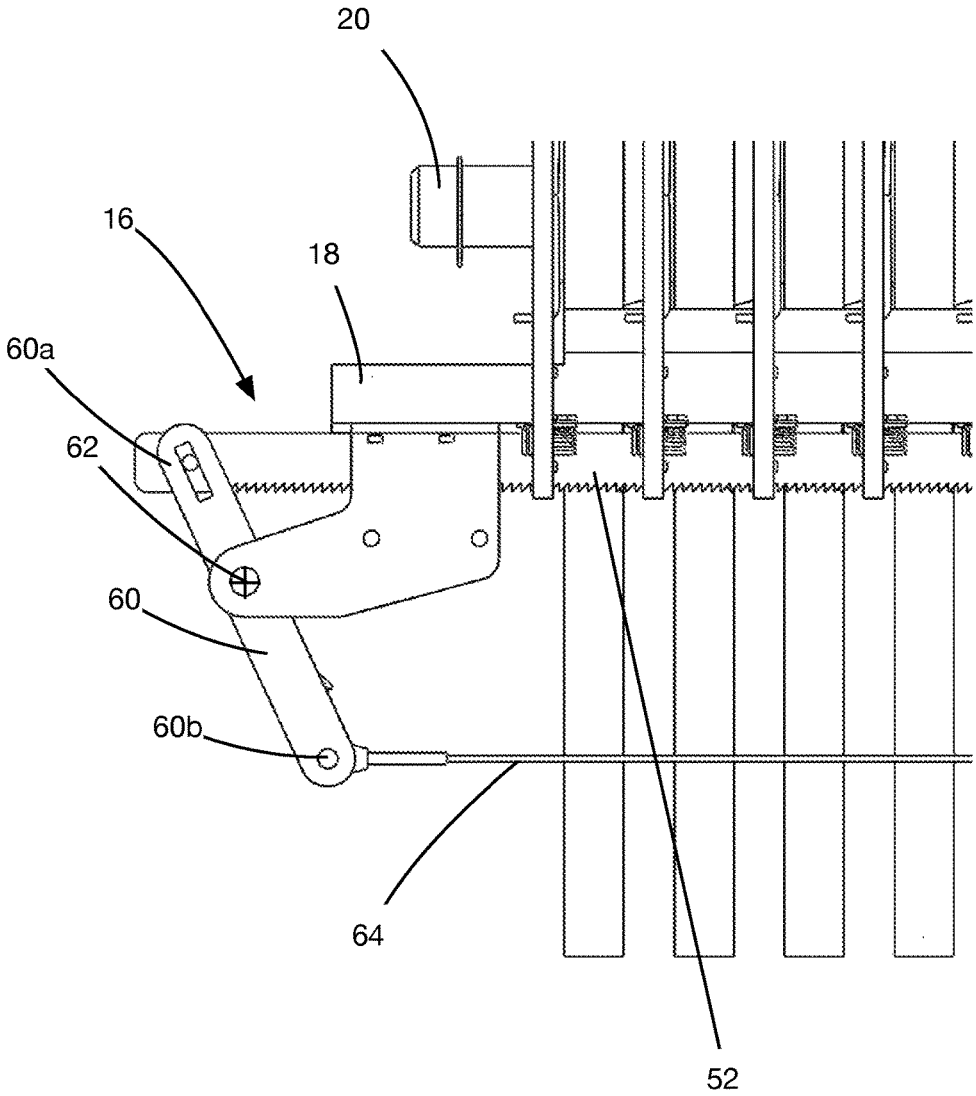
FIG. 9B is an elevation view of a portion of the target reset system shown in FIG. 1, with the ratchet member from the actuator in a second position.
Figure 10:
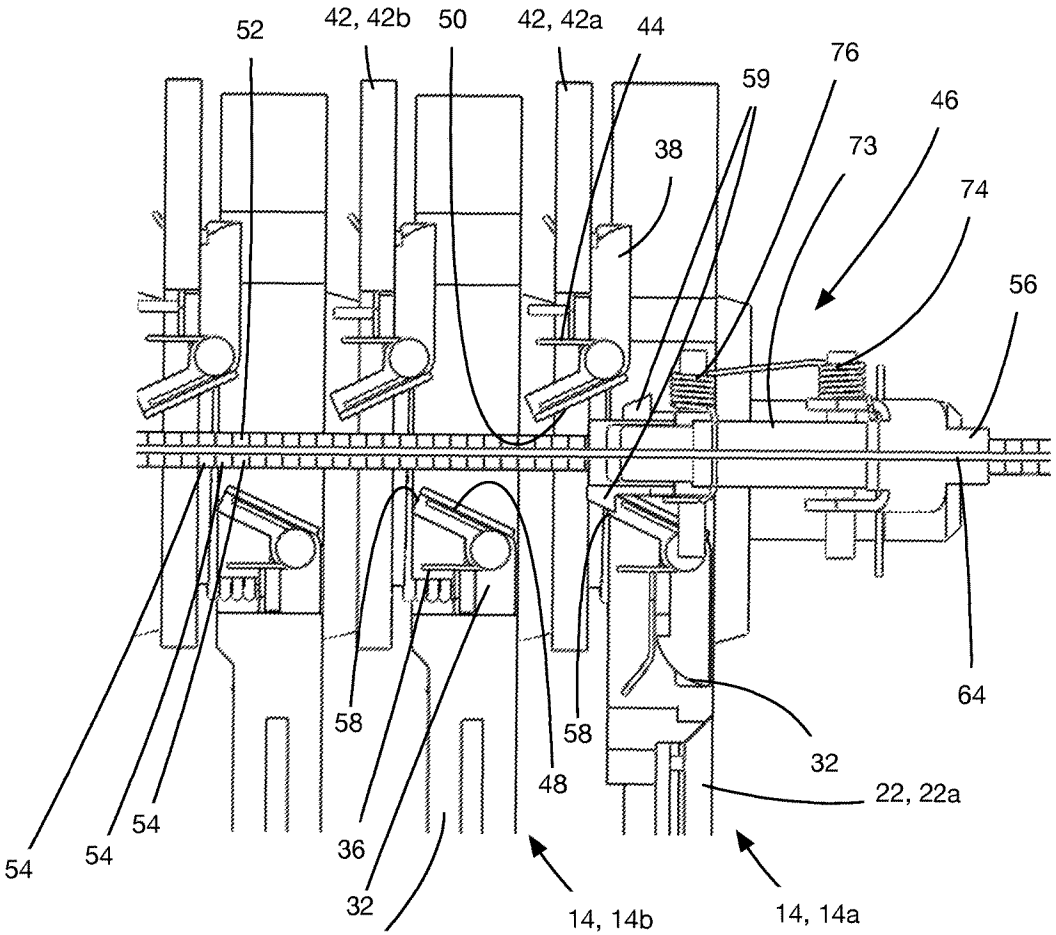
FIGS. 10-15 are plan views of a portion of the actuator from the target reset system shown in FIG. 1, illustration movement of elements of the actuator.
Figure 11:
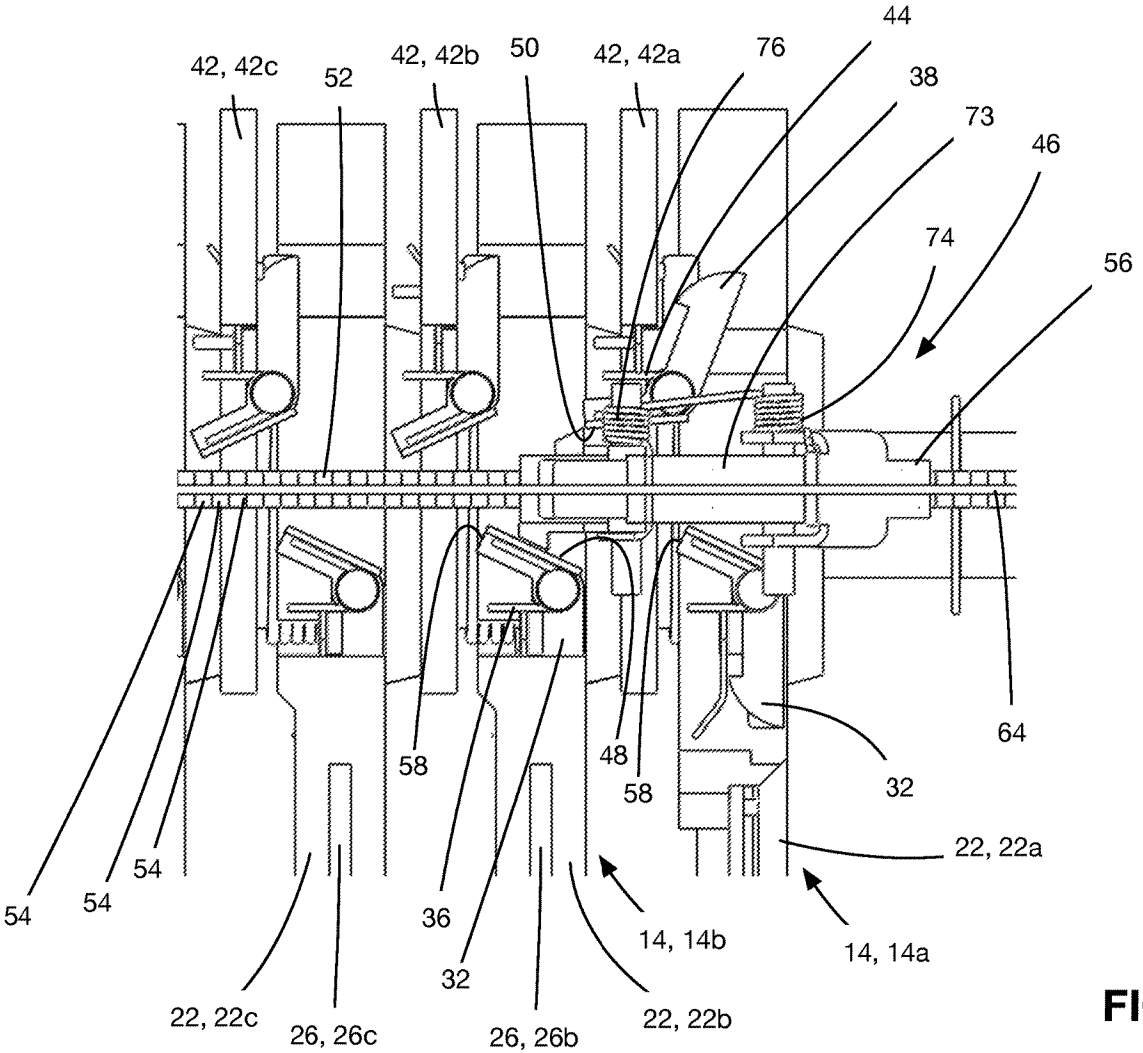
Figure 14:
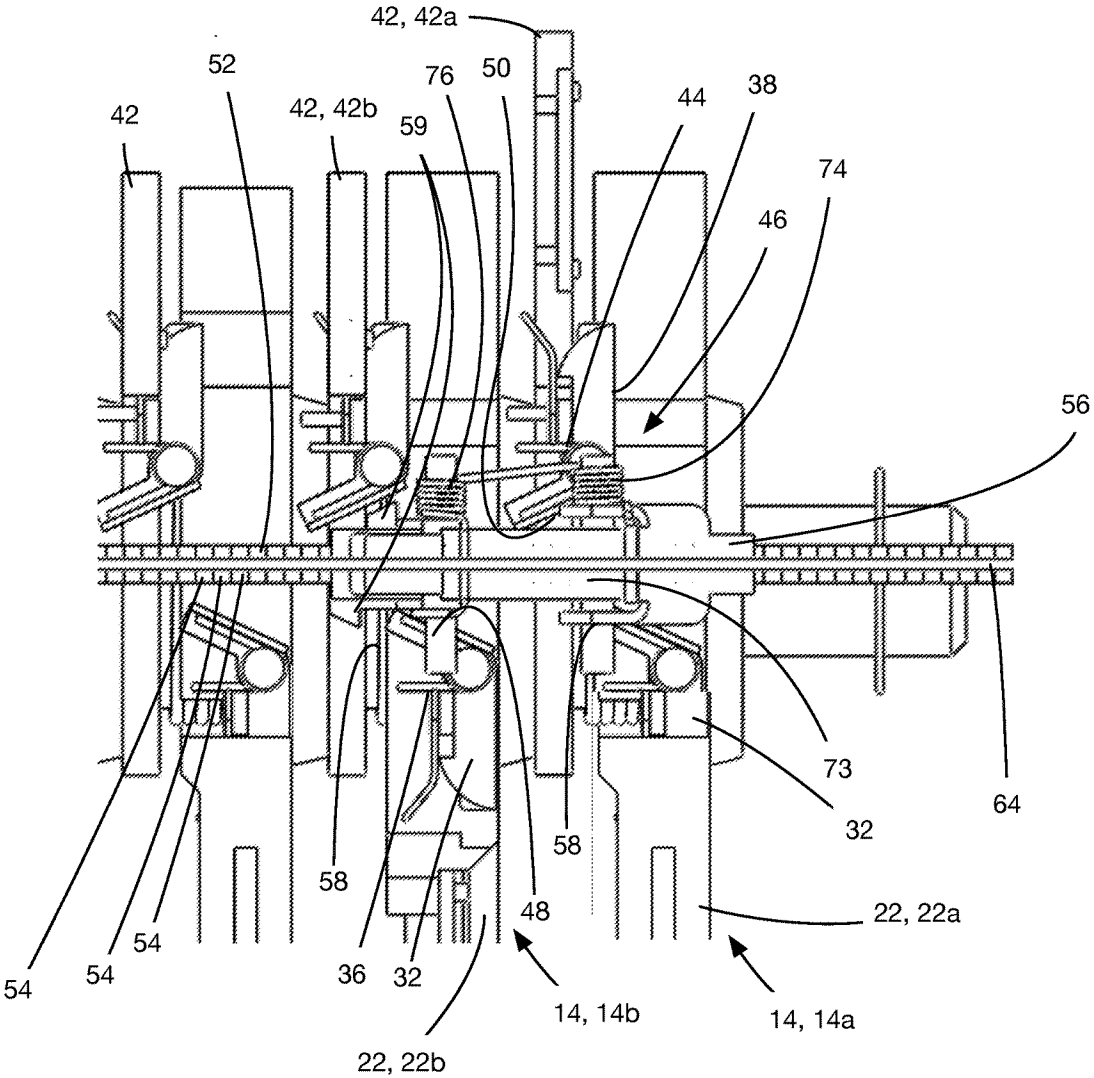

The ratchet member 52 has a plurality of ratchet teeth 54 thereon and which is movable between a first ratchet member position (FIGS. 9A and 10) and a second ratchet member position (FIGS. 9B and 14). The shuttle 46 includes a pawl 56. The pawl 56 and the ratchet teeth 54 are arranged such that the pawl 56 engages the ratchet teeth 54 to prevent relative movement between the shuttle 46 and the ratchet member 52 in one direction, but rides over the ratchet teeth 54 to permit relative movement between the shuttle 46 and the ratchet member 52 in an opposing second direction. The pawl 56 is biased towards engagement with the ratchet teeth 54 by a pawl biasing spring 57.

Figure 12:
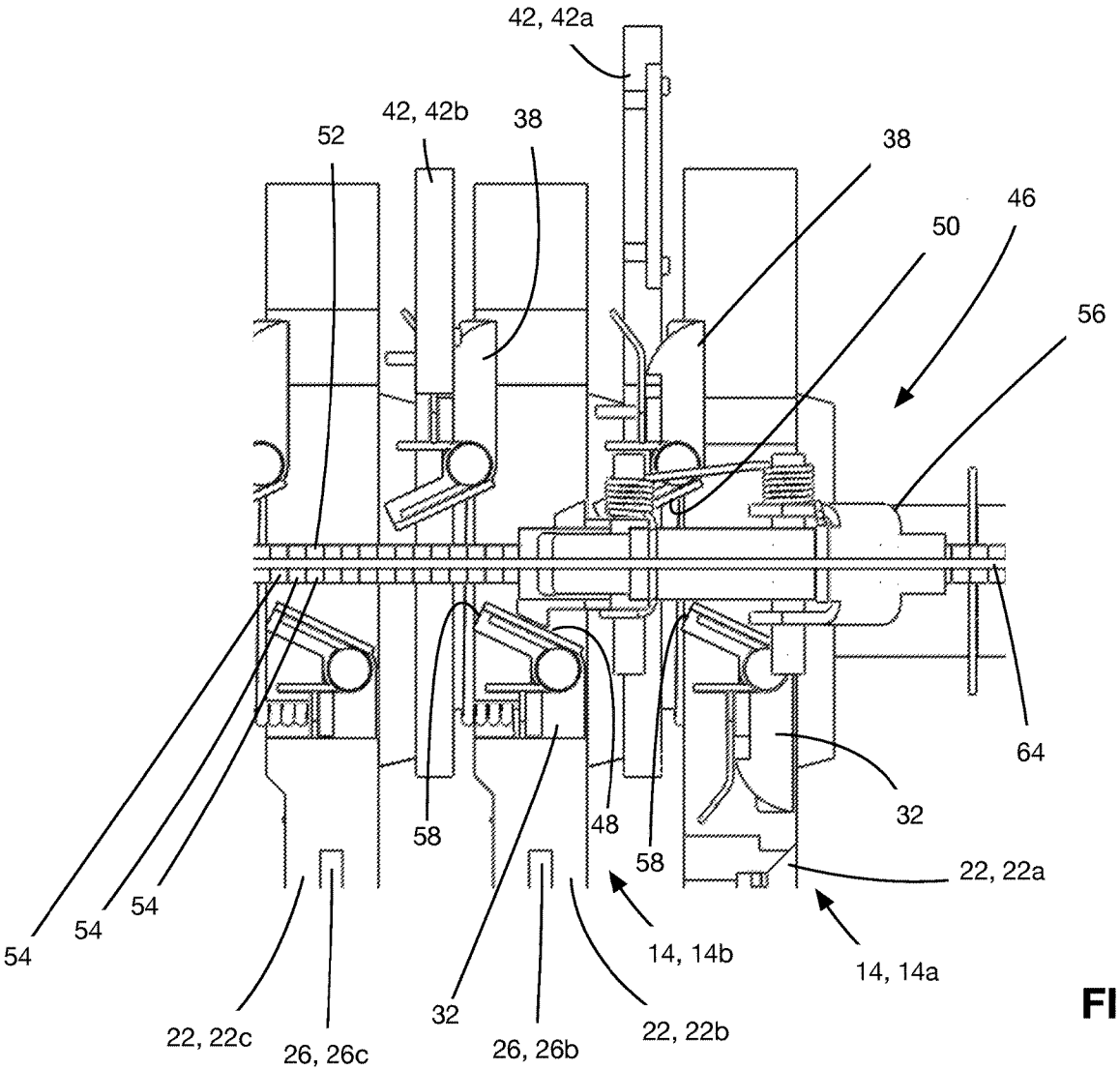
Figure 13:
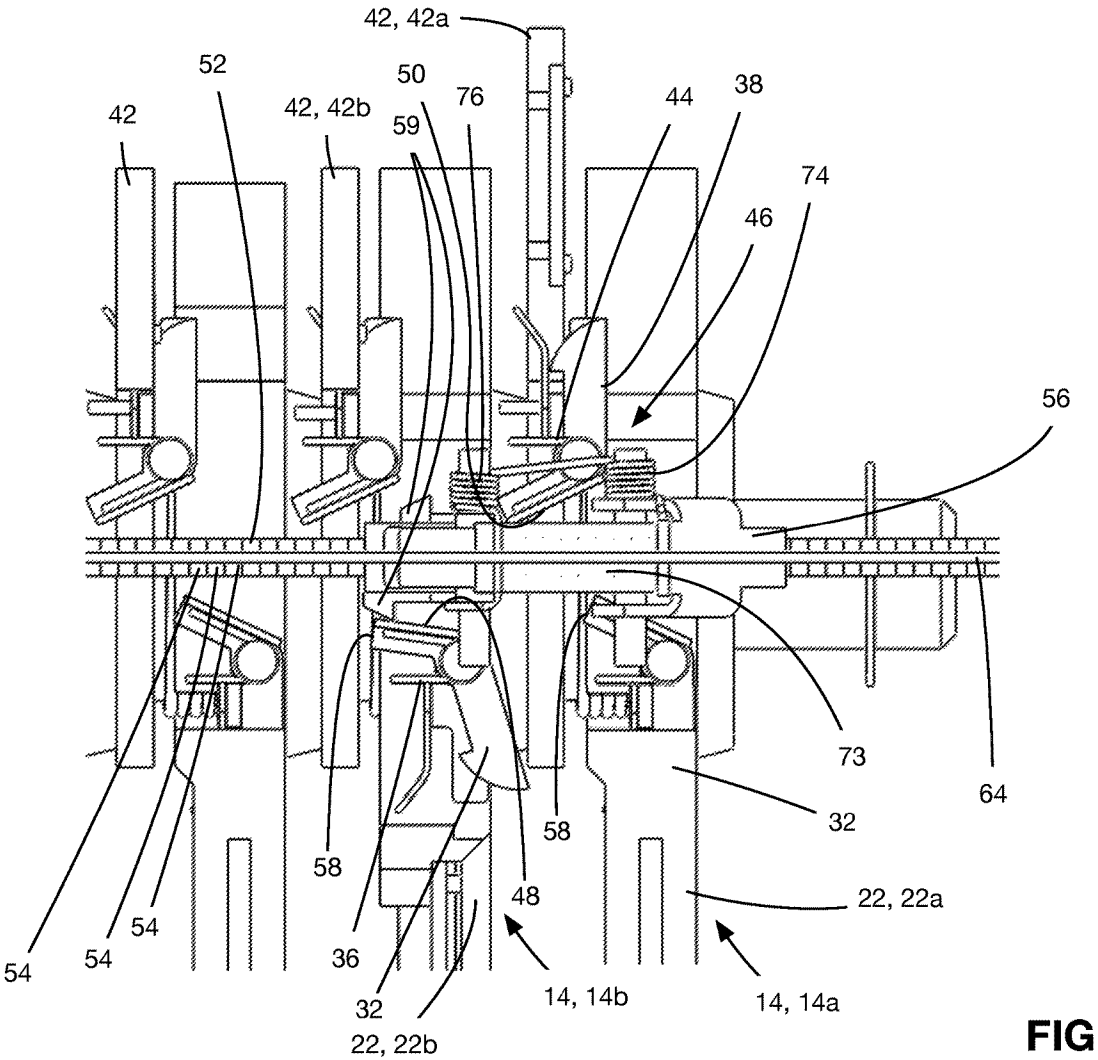

As described herein, in the example shown, the ratchet member 52 is movable from the first ratchet member position (FIG. 9A) to the second ratchet member position (FIG. 9B) and then back again to the first ratchet member position. As a result of the arrangement of the pawl 56 and the ratchet teeth 54, the pawl 56 holds the shuttle 46 with the ratchet member 52 during movement of the ratchet member 52 from the first ratchet member position to the second ratchet member position, which brings the shuttle 46 from the first shuttle position (FIG. 10) to the second shuttle position (FIG. 14). The movement of the shuttle 46 causes the shuttle 46 to pass by and actuate the second latch arm 38 from the current target control arrangement 14 (e.g. the first target control arrangement 14*a*) and to pass by and actuate the first latch arm 32 from the subsequent target control arrangement 14 (e.g. the second target control arrangement 14*b*). Thus, for the current (e.g. first) target control arrangement 14 the shuttle 46 moves the second latch arm 38 to disengage from the associated second latch arm receiver 40, thereby unlocking the associated second spring end 30 from the frame 12, so as to permit the current target 26 (e.g. the first target 26*a*) to drop down to its stowage position (FIG. 12). For the subsequent (e.g. second) target control arrangement 14 the shuttle 46 moves the first latch arm 32 to disengage from the associated first latch arm receiver 34, thereby unlocking the associated first spring end 29 from the frame 12, so as to permit the subsequent target 26 (e.g. the second target 26*b*) to rise from its stowage position to the use position (FIG. 14).

Because the ratchet member 52 actuates the first and second latch arms 32 and 38 during movement of the ratchet member 52 from the first position to the second position, this movement may be referred to as an actuation stroke.

During movement of the ratchet member 52 from the second ratchet member position to the first ratchet member position a first shuttle stop surface 58 engages the shuttle 46 to prevent the shuttle 46 from moving past a third shuttle position (FIG. 15) as it moves back with the ratchet member 52. In other words, as the shuttle 46 moves with the ratchet member 52 back towards the first shuttle position, the shuttle 46 is blocked by the first shuttle stop surface 58. In the example shown, the first shuttle stop surface 58 may be provided on an end of the first latch arm 32. The surface of the shuttle 46 that engages the first shuttle stop surface 58 may be provided on a shuttle-mounted reset element 59, which is described further below.

The ratchet member 52 continues to move towards its first position, however the pawl 56 rides over the ratchet teeth 54 and the shuttle 46 remains in the third shuttle position. In this way, the movement of the ratchet member 52 does not need to be precisely a certain distance so as to match the exact pitch of the first and second latch arms 32 and 38, since the shuttle 46 is retracted to a known position during the return stroke of the ratchet member 52. In other words, if the length of the actuation stroke of the ratchet member 52 is greater than the pitch between successive first latch arms 32 (shown at P1) and between successive second latch arms 38 (shown at P2, wherein the two pitches P1 and P2 will in preferred embodiments be the same) and as long as the stroke of the ratchet member 52 is not too long the shuttle 46 will actuate one first latch arm 32 and one second latch arm 38 during the actuation stroke. It will be noted that in some embodiments, the length of the actuation stroke of the ratchet member 52 to be selected so that the shuttle 46 actuate two or more first latch arms 32 and two or more second latch arms 38, so as to drop two old targets 26 and raise two new targets 26 each time.

Figure 15:
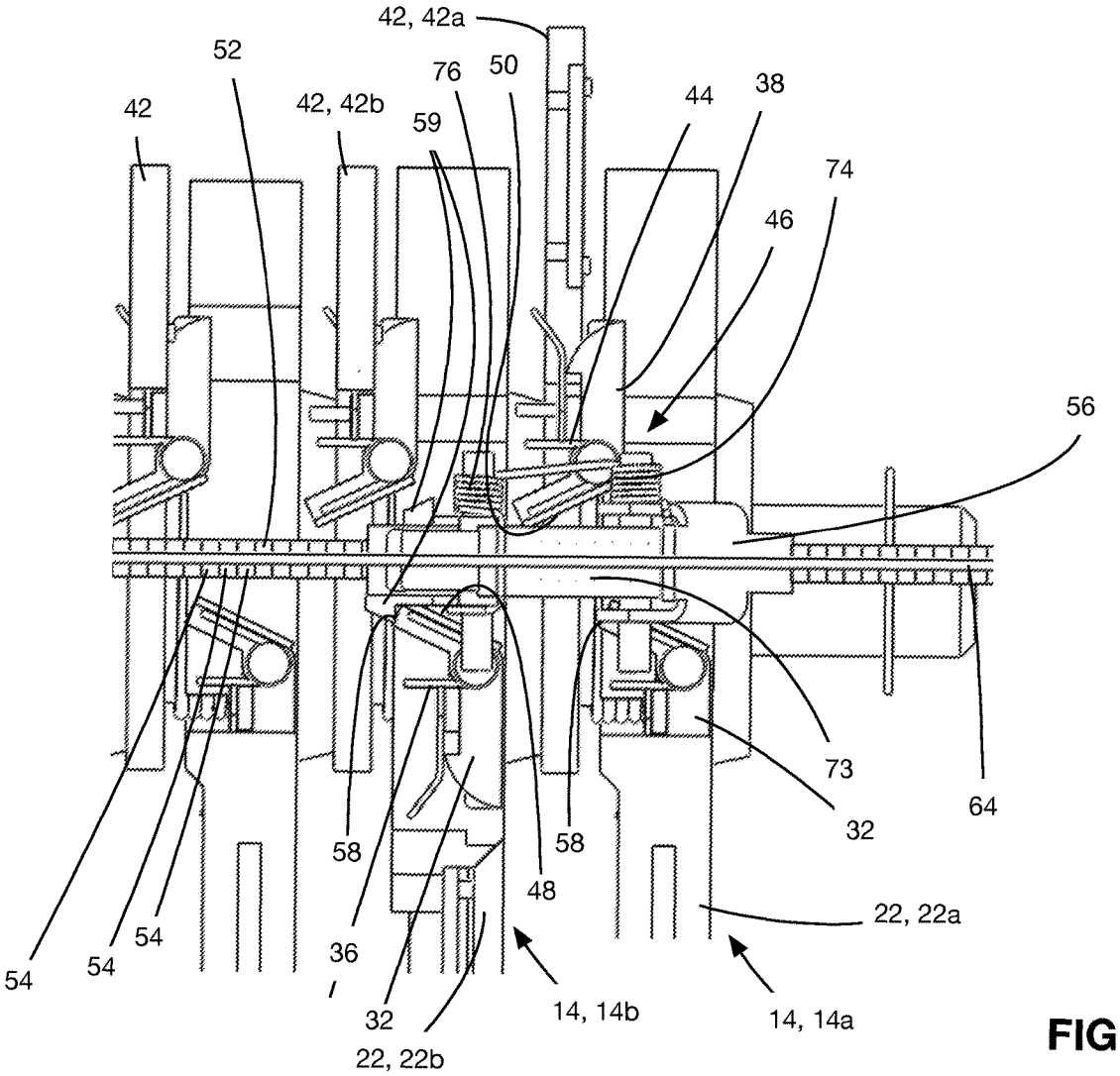
Figure 16:
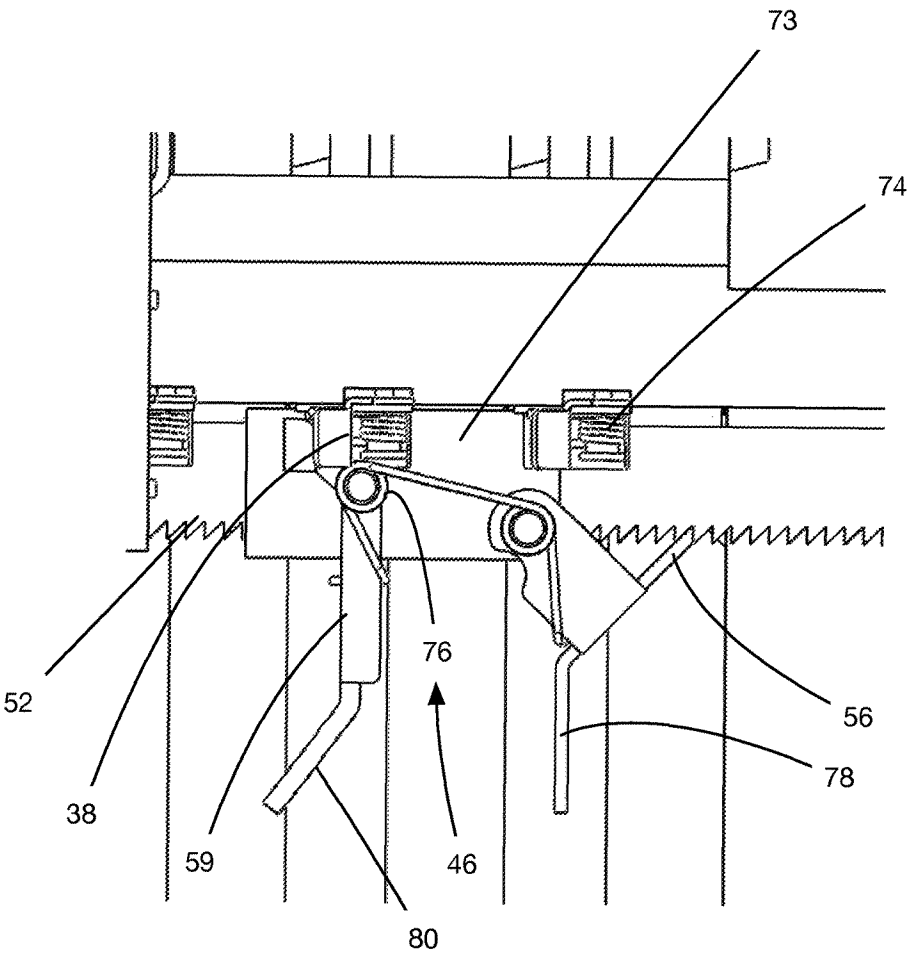
FIG. 16 is an elevation view of a shuttle from an actuator that is part of the target reset system shown in FIG. 1, in a first condition.

The position of the shuttle 46 in FIG. 15 becomes the first position for the shuttle 46 during the next actuation of the ratchet member 52.

The ratchet member 52 may be actuated using any suitable structure. In the example shown, and with reference in particular to FIGS. 9A and 9B, the ratchet member 52 has a first end 52*a* that is pivotally connected to a first end 60*a* of a pivot arm 60, optionally via a pin on the ratchet member 52 that engages a slotted hole on the pivot arm 60. The pivot arm 60 is pivotally connected at an intermediate point to the frame 12 for pivoting about pivot axis 62, and has a second end 60*b* that is connected to an actuator cable 64. Referring to FIG. 9A, the actuator cable 64 may be connected to any suitable type of electric drive member such as a solenoid, shown at 68. The ratchet member 52 may be biased by a ratchet member biasing member 66 towards the first ratchet member position. The ratchet member biasing member 66 may be any suitable type of spring, such as a torsion spring that acts on the pivot arm 60. When the solenoid is energized, the ratchet member 52 is moved from the first ratchet member position (FIG. 9A) to the second ratchet member position (FIG. 9B). When the solenoid 68 is deenergized, the ratchet member 52 returns to the first ratchet member position by way of the ratchet member biasing member 66.

A remote control 70 may be provided so as to permit a user to actuate the solenoid (or whatever other mover is chosen) remotely. An inexpensive controller 71 may be provided with the solenoid to receive actuation signals from the remote control and to control power to the solenoid from a suitable power source such as a battery shown at 72 in embodiments where the target reset system is intended to be portable or such as 120 VAC wall power in stationary applications.

Referring to FIGS. 1 and 2, the target reset system 10 may initially be set up such that the first target support arrangement 14*a* (and therefore only the first target 26) is in the raised position, while all the other target support arrangement 14 and targets 26 are in their reset positions. The target reset system 10 may be set up such so as to be shielded by a protective housing, wherein only raised targets 26 are visible to the user. The user may then shoot at the first target 26*a* with a pistol, a rifle, a cross-bow or any other suitable device for launching a projectile. Once the first target 26*a* has been sufficiently hit by the user, the user can actuate the remote control 70 to move the shuttle 46 so as to drop the first target 26*a* and to raise the second target 26*b*. Once the second target 26*b* has been sufficiently hit by the user, the user can actuate the remote control 70 to move the shuttle 46 so as to drop the second target 26*b* and to raise a third target 26*c*.

Once the shuttle 46 has moved all the way across the ratchet member 52 such that all the targets 26 have been used, a user can remove the used targets 26 from the target reset system 10, insert new targets 26 onto the target support members 22 and can return the target support arrangements 14 to their reset positions by manually moving both the target support member 22 and the second spring end extension member 42 to their first positions for each target support arrangement 14. Optionally the first target support member 22 may be left in the raised position so as to be ready for use.

Figure 17:
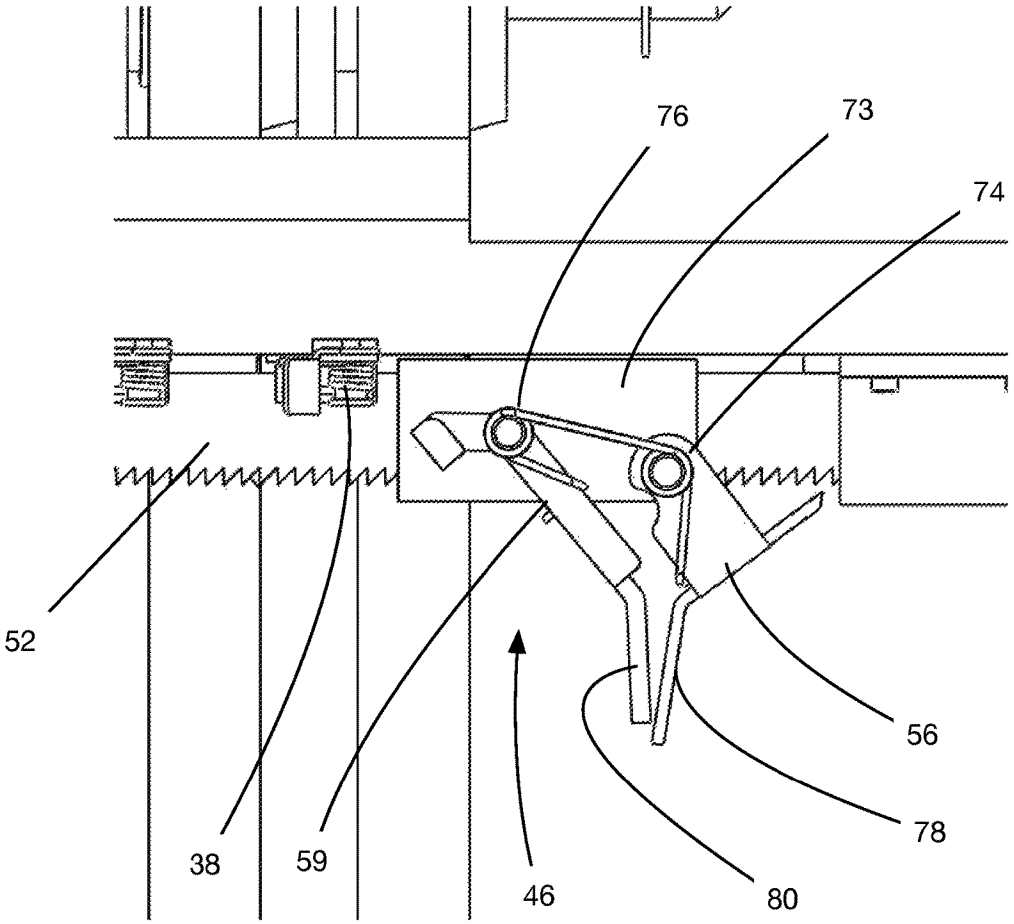
FIG. 17 is an elevation view of the shuttle shown in FIG. 15, in a second condition.

In order to reset the shuttle 46 (i.e. to move the shuttle 46 back to its first position so as to be ready to drop the first target 26*a* and raise the second target 26*b*), the pawl 56 is moved out of the teeth 54 of the ratchet member 52, and the shuttle-mounted reset element 59 is moved out of the way of the shuttle stop surfaces 58 so as to permit the shuttle 46 to move freely in the needed direction. For this purpose, the pawl 56 and the shuttle-mounted reset element 59 may be mounted pivotally to a shuttle body 73 of the shuttle 46. The pawl 56 and the shuttle-mounted reset element 59 may each by biased towards active positions (FIG. 16) so as to engage the ratchet teeth 54 and the shuttle stop surfaces 58 respectively by a pawl biasing member 74 and a reset element biasing member 76 respectively. The pawl 56 and the shuttle-mounted reset element 59 may include finger-holds shown at 78 and 80 respectively (FIGS. 16 an 17) to permit the user to move them out of their active positions (as shown in FIG. 17) in order to reset the shuttle 46.

It will also be noted that, as described herein, the target reset system 10 is easily scaled to hold a larger or smaller number of targets 26 than is shown, by changing relatively few components, such as by changing the length of the frame 12 and pivot shaft 20, changing the length of the ratchet member 52, and increasing or decreasing the number of target support arrangements 14. It can be seen that the configuration of the shuttle 46, the configuration of each target support arrangement 14 need not change.

In an alternative embodiment, the actuator 16 may have a different structure than the structure shown in the figures. For example, the actuator 16 may include a ratchet wheel that is rotatable about a ratchet axis, and a pawl arm that is pivotable about the ratchet axis, and which has a first, drive pawl pivotally mounted thereto. Actuation of the pawl arm drives the pawl into the teeth of the ratchet wheel, which drives the ratchet wheel in a 'forward' angular direction by a selected angular stroke. The ratchet wheel is rotationally connected to a shuttle drive wheel, which by any suitable connection, such as by means of a square shaft that passes through square apertures in both the ratchet wheel and the shuttle drive wheel. The shuttle drive wheel may be a pulley. A shuttle support cable may extend around the shuttle drive wheel and over to and around an idler wheel. A shuttle may be fixedly mounted to the cable. As a result, as the pawl arm is pulled through a selected angular stroke, it drives the ratchet wheel and therefore the shuttle drive wheel through that angular stroke, which in turn drives the cable, which in turn drives the shuttle linearly through a shuttle stroke. The shuttle would actuate first and second latch arms similar to the latch arms 32 and 38 so as to move a target 26 to a stowage position and move a subsequent target 26 to a use position. The pawl arm can then be returned to a home position by way of a pawl arm biasing spring or the like. The drive pawl slides over the ratchet teeth of the ratchet wheel during this return of the pawl arm to the home position. A second, position locking pawl on the frame 12 engages the teeth on the ratchet wheel and prevents movement of the ratchet wheel in a 'backwards' direction, so that the ratchet wheel remains stationary while the pawl arm is returned to the home position.

Actuation of the pawl arm can be achieved via a cable and a solenoid (similar to cable 64 and solenoid 68 in FIG. 9A), or by any other suitable structure.

When all the targets 26 have been used up, the user can then replace all the targets 26 and will, in at least some embodiments, want to reset the shuttle (i.e. move it back to a reset position which is its first position wherein it is ready to drop the first target 26*a* and raise the second target 26*b*). To reset the shuttle, the user may withdraw the square shaft from the shuttle drive wheel so that the shuttle drive wheel is free to rotate. A shuttle reset spring may be provided on the shuttle drive wheel or on the idler wheel to rotate backwards, so as to drive the shuttle support cable and therefore the shuttle all the way back to its reset position. It will be noted that the shuttle in such an embodiment does not require a stop surface 58, since it is simply stroked (i.e. indexed) to a new position with each stroke of the pawl arm and remains substantially in whatever position it is in until being stroked forward again. In order to reset the shuttle, the surfaces of the shuttle may be provided on a shuttle reset arm similar to shuttle reset arm 59, or alternatively, the surfaces may be provided on pivoting arms that provide little resistance to being pivoted out of the way when they engage the latch arms while the shuttle is returning to its reset position, but which do not pivot out of the way when engaging the latch arms while the shuttle is being moved forwardly. Once the shuttle is returned to its reset position, the square shaft may be reinserted through the shuttle drive wheel so as to rotationally lock the shuttle drive wheel with the ratchet wheel. At this point the, the system is ready for use to move targets between stowage and use positions.

While a square shaft is described as passing through square apertures in the shuttle drive wheel and the ratchet wheel, it will be understood that any other suitable shape could alternatively be used for the shaft such that the shaft is slidable out of and into driving engagement with the shuttle drive wheel. For example, the shaft could have some other non-round shape such as a D-shape, an elliptical shape or a triangular shape.

It will be noted that, as described herein, particularly when operated via a battery, the target reset system 10 may be made easily portable.

The target reset 10 is relatively easy to install whether in portable form or in a form intended for operation from wall power, since it is a self-contained unit.

Persons skilled in the art will appreciate that there are yet more alternative implementations and modifications possible, and that the above examples are only illustrations of one or more implementations. The scope, therefore, is only to be limited by the claims appended hereto.

What is claimed is:

1. A target reset system, comprising:

a frame that includes a pivot shaft;

a plurality of target control arrangements, wherein each target control arrangement includes:

a target support member that is configured to hold a target, and which is pivotable on the pivot shaft between a stowage position and a use position, a target support member spring having a first spring end connected to the target support member and having a second spring end, wherein the first spring end is lockable to the frame to hold the target support member in the stowage position, wherein the second spring end is lockable relative to the frame, wherein, when the first spring end is unlocked from the frame while the second spring end is locked to the frame, the target support member spring pivots the target support member from the stowage position to the use position, wherein, when the second spring end is unlocked from the frame while the target support member is in the use position, the target support member moves to the stowage position; and an actuator that is movable to unlock the second spring end of a first one of the plurality of target control arrangements from the frame while the target support member of the first one of the plurality of target control arrangements is in the use position, and to unlock the first spring end of a second one of the plurality of the target control arrangements from the frame while the second spring end of the second one of the plurality of the target control arrangements is locked to the frame, so as to cause the target support member from the first one of the plurality of target control arrangements to move to the stowage position and to cause the target support member from the second one of the plurality of target control arrangements to move to the use position.

2. A target reset system as claimed in claim 1, wherein, for each of the plurality of target control arrangements, the second spring end is connected to a second spring end extension member that is pivotable about the shaft, and which is lockable to the frame to lock the second spring end to the frame.

3. A target reset system as claimed in claim 1, wherein the target support member spring is a torsion spring.

4. A target reset system as claimed in claim 1, wherein, for each of the plurality of target control arrangements, the first spring end is lockable to the frame via a first latch arm that is movable to a locking position in which the first latch arm releasably engages a first latch receiver, and the second spring end is lockable to the frame via a second latch arm that is movable to a locking position in which the second latch arm releasably engages a second latch receiver, and wherein the actuator includes a shuttle that is movable between a first shuttle position and a second shuttle position to disengage the second latch arm from the second latch receiver of the first one of the plurality of target control arrangements thereby unlocking the second spring end from the frame of the first one of the plurality of target control arrangements, and to disengage the first latch arm from the first latch receiver of the second one of the plurality of target control arrangements thereby unlocking the first spring end of the second one of the plurality of target control arrangements from the frame.

5. A target reset system as claimed in claim 4, wherein the first and second latch arms are biased towards the respective locking positions.

6. A target reset system as claimed in claim 4, wherein the actuator further includes a ratchet member having ratchet teeth and which is movable between a first ratchet member position and a second ratchet member position, and wherein the shuttle includes a pawl, wherein the pawl and ratchet teeth are arranged such that the pawl holds the shuttle with the ratchet member during movement of the ratchet member from the first ratchet member position to the second ratchet member position, which brings the shuttle from the first shuttle position to the second shuttle position, and wherein a first shuttle stop surface engages the shuttle to prevent the shuttle from moving past a third shuttle position with the ratchet member during movement of the ratchet member from the second ratchet member position to the first ratchet member position.

7. A target reset system as claimed in claim 6, wherein the first shuttle stop surface is on one of the first and second latch arms.

8. A target reset system as claimed in claim 6, wherein the actuator further includes an electric drive member to drive the ratchet member from the first ratchet member position to the second ratchet member position so as to bring the shuttle from the first shuttle position to the second shuttle position and to drive the ratchet member from the second ratchet member position to the first ratchet member position so as to bring the shuttle from the second shuttle position to the third shuttle position.

9. A target reset system as claimed in claim 8, wherein the electric drive member is a solenoid.

10. A target reset system as claimed in claim 8, further comprising a remote control that is operatively connected to the electric drive member to cause the electric drive member to drive the ratchet member in the first and second directions.

11. A target reset system as claimed in claim 6, wherein the plurality of target control arrangements further includes a third target control arrangement, and wherein the pawl and ratchet teeth are arranged such that the pawl holds the shuttle with the ratchet member during a subsequent movement of the ratchet member from the first ratchet member position to the second ratchet member position, which brings the shuttle from the third shuttle position to a fourth shuttle position, and wherein a second shuttle stop surface engages the shuttle to prevent the shuttle from moving past a fifth shuttle position with the ratchet member during movement of the ratchet member from the second ratchet member position to the first ratchet member position, wherein the actuator is movable to unlock the second spring end of the second one of the plurality of target control arrangements from the frame while the target support member of the second one of the plurality of target control arrangements is in the use position, and to unlock the first spring end of the third one of the plurality of the target control arrangements from the frame while the second spring end of the third one of the plurality of the target control arrangements is locked to the frame, so as to cause the target support member from the second one of the plurality of target control arrangements to move to the stowage position and to cause the target support member from the third one of the plurality of target control arrangements to move to the use position.

* * * * *